United States Patent [19]

Brewer et al.

[11] 4,290,236

[45] Sep. 22, 1981

[54] METHOD AND APPARATUS FOR MANUFACTURING A CONTOURED INTERNAL DIAMETER BUSHING

[75] Inventors: Thomas D. Brewer, Tremont; Robert J. Purcell; James R. Sturges, both of Washington, all of Ill.

[73] Assignee: Caterpillar Tractor Co., Peoria, Ill.

[21] Appl. No.: 89,117

[22] PCT Filed: May 14, 1979

[86] PCT No.: PCT/US79/00322

§ 371 Date: May 14, 1979

§ 102(e) Date: May 14, 1979

[87] PCT Pub. No.: WO80/02525

PCT Pub. Date: Nov. 27 1980

[51] Int. Cl.[3] ..... B24B 1/00; B24B 5/40

[52] U.S. Cl. ..... 51/5 A; 51/227 R; 51/290; 51/324; 72/370; 72/402; 59/8

[58] Field of Search ..... 51/5 A, 56 R, 161, 227 R, 51/281 SP, 290, 324; 59/8; 72/370, 402; 279/66, 110; 408/19; 409/143

[56] References Cited

U.S. PATENT DOCUMENTS

| | | | |
|---|---|---|---|
| 839,776 | 12/1906 | Lewis | 279/110 |
| 1,493,515 | 5/1924 | Berthold | 72/402 |
| 1,895,819 | 1/1933 | Remington | 51/324 |
| 2,049,841 | 8/1936 | Kjaer | 59/8 X |
| 2,431,702 | 12/1947 | McCann | 59/8 X |
| 2,431,764 | 12/1947 | McCann | 59/8 X |
| 3,160,420 | 12/1964 | Simpson | 279/110 |
| 3,685,216 | 8/1972 | Frey | 51/325 |

*Primary Examiner*—Gary L. Smith

*Attorney, Agent, or Firm*—Phillips, Moore, Weissenberger, Lempio & Majestic

[57] ABSTRACT

The ends (14,16) of cylindrical bushings 10) in which pins rotate bear relatively heavy loads. This can lead to a slight internal deformation of the bushing (10) which can interfere with free rotation of the pin. Such a problem is encountered, for example, with track pin bushings. A solution to this problem is to contour the ends (14,16) of the bushing (10) so that the inner diameter thereof flares (28,30) outwardly toward the bushing ends (14,16). This has not previously been accomplished via a single relatively non-critical operation. In the present invention a first end (14) of a cylindrically bored tube (10) is compressed radially inwardly sufficient to force it to a reduced internal diameter (18). The tube (10) is then bored axially inwardly while it is compressed with a boring tool (22) which bores a hole of a diameter (21) greater than the diameter (18) induced by the compressing. After the boring, the end (14) is released and its external dimension (24) returns towards its uncompressed size.

7 Claims, 5 Drawing Figures

METHOD AND APPARATUS FOR MANUFACTURING A CONTOURED INTERNAL DIAMETER BUSHING

DESCRIPTION

1. Technical Field

This invention relates to forming tubes with a generally uniform outward flaring of the interior of the ends thereof. Such tubes are particularly useful as bushings which serve as bearings for pins, particularly for track pins as are utilized with an endless track drive vehicle.

2. Background Art

Cylindrical or tubular bushings are normally utilized as bearings for coaxially placed pins in track roller assemblies, and in many other structures as well. The ends of the bushing are normally held in place by a structural member which is relatively non-rotating while the pin ends are normally connected to a relatively rotating member. The bushings, of course, have a cylindrical bore therein. Heavy stress is created at the ends of the bore where the bushing is mounted to the relatively stationary support members. The bore can become distorted due to this stress and can bear against the pin in an undesirable manner which would interfere with the relative rotation between the bushing and the pin. It is thus desirable to provide bushings which have the internal diameters thereof flared outwardly to closely match the curvature which the pin assumes on being deformed during high loading thereof.

It is known to provide bushings which have the internal diameters thereof adjacent the ends thereof flared outwardly. For example, U.S. Pat No. 2,431,702 issued on Dec. 2, 1947 to J. F. McCann discloses one such bushing wherein not only the internal diameter flares outwardly at the ends of the bushing but the external diameter also flares outwardly. These flared ends are produced by placing the bushing in a suitable die having a shape of a desired external contour and punches are inserted into the tube from the opposite ends thereof with sufficient force to plastically deform the bushing so that the outer contour abuts the die and the inner contour or diameter flares outwardly. Because of the plastic flow, the bushing can be somewhat embrittled by such treatment. Further, such treatment requires a separate operation at each end of the bushing and is hence somewhat time consuming. Still further, such a procedure generally provides a relatively sharply stepped bore contour which, at the transition area, will bear on the pin and can gall the pin and eventually ruin it.

A method is taught by V. A. Kjaer in U.S. Pat. No. 2,049,841 issued Aug. 4, 1936, wherein only the internal diameters of a bushing are flared outwardly at the ends thereof while the external diameter remains unchanged. This is accomplished by individually treating each end of the bushing with a cutting tool held at an angle to the axis of the middle portion of the bushing. This has the disadvantage of requiring two separate operations if the same bit is used on each end of the bushing. Alternatively, if two cutting tools are utilized, this requires the use of the second cutting tool and a fairly complex aligning structure which will allow both cutting tools to properly contour each end of the bearing. Further, when a cutting tool is utilized, it is always necessary to very carefully align the tool and the part being cut. Still further, when a cutting tool is utilized, a relatively stepped bore results, that is there is not a completely smooth transition from the cylindrical portion of the bore to the flared portions with the previously mentioned problem of pin damage resulting.

It would be desirable to provide a bushing which had a bore which tapers outwardly towards the ends thereof but which did not suffer from the aforementioned problems and which could be formed in a relatively short period of time.

DISCLOSURE OF INVENTION

The present invention is directed to overcoming one or more of the problems as set forth above.

In accordance with one embodiment of the present invention, a method is provided for forming outwardly flaring tapers on the cylindrical bores of tubes. A first end of a tube having a cylindrical bore is compressed generally uniformly radially inwardly sufficiently to force the first end to be deformed to a reduced internal diameter. While compressed, the tube is bored axially inwardly from its first end with a boring tool which bores a hole of greater diameter than the first end reduced internal diameter. The compressing is released to allow the external dimension of the first end to return towards its uncompressed size with concomitant generally uniform outward flaring of the bore first end.

In another aspect of the present invention an apparatus is provided for generally uniformly radially inwardly compressing the ends of cylindrically bored tubes. A plurality of generally arcuate compression segments, each having front and back faces, inward and outward faces, and a pair of ends, the segments abutting together end to end to form a circular ring having a first internal diameter formed at inward radial edges of the front faces and the second and larger internal diameter formed at inward radial edges of the back faces, forms a part of the apparatus. Additionally, means are provided for generally uniformly radially inwardly compressing the segments to form the ring.

When operating in accordance with the present invention, the problem of bore distortion at the ends of bushings having cylindrical bores is alleviated by the provision of outward flaring of the internal diameters of the ends of the bores. This is accomplished without the introduction of a stepped bore contour which could lead to galling of a pin which is bearingly supported in the bore, as when the bushing is, for example, a track pin bushing. The flaring is accomplished at both ends of the bushing by a single, relatively quick to perform operation.

BEST MODE FOR CARRYING OUT THE INVENTION

Figure 1:
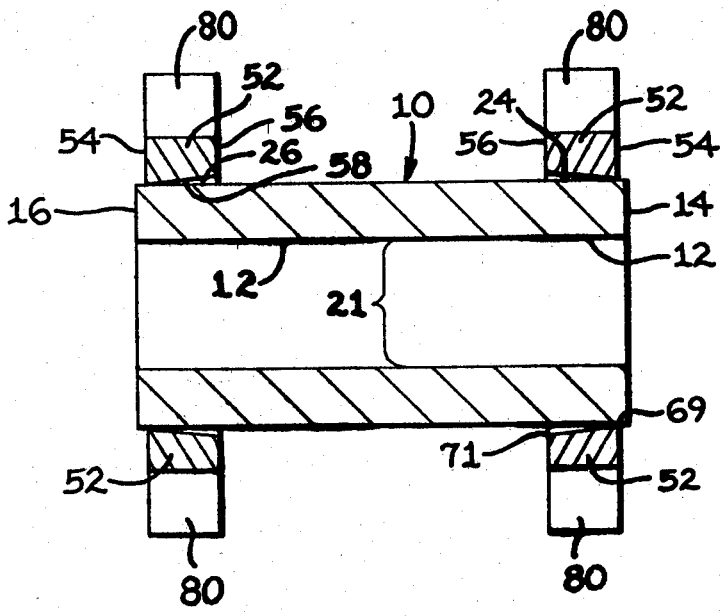
FIG. 1 illustrates an embodiment of the method and apparatus of the present invention in side sectional view.

Adverting to FIG. 1 there is illustrated therein a track bushing 10 which serves as a bearing for a pin (not illustrated). As will be noted, the bushing 10 is in the form of a tube having a cylindrical bore 12. As shown in FIG. 1, the ends 14 and 16 of the bushing 10 do not have any internal tapers therein, but instead, the bore 12 is cylindrical along its entire length.

Figure 2:
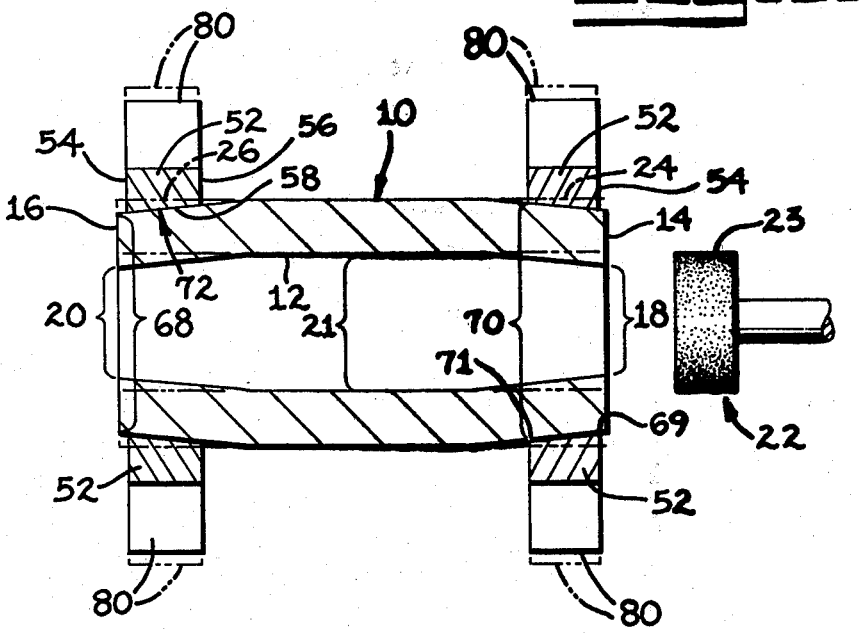
FIG. 2 illustrates a view similar to FIG. 1 and particularly illustrates via dashed and solid lines the compressing and boring steps of the method along with a boring tool useful therein.

Turning next to FIG. 2 it will be seen that the ends 14 and 16 (solid lines) of the bearing 10 have been compressed radially inwardly sufficiently to deform them whereby the first end 14 has an internal diameter 18 and the second end 16 has an internal diameter 20, the internal diameters 18 and 20 being less than the undeformed internal diameter 21 of the bore 12. A boring tool 22 then bores axially inwardly from the first end 14 while the compressing is maintained. The boring tool 22 bores a hole of greater diameter than the reduced diameter 18. Generally, the boring tool 22 would be passed entirely through the bushing 10 and would also bore an identical diameter hole at the second end 16 of the bushing 10. Normally, the boring tool 22 would bore a hole of a diameter substantially equal to the inner diameter 21 of the bore 12 in the absence of compression. In this manner, the boring tool 22 would then not be doing any boring within the central portion of the bushing 10, namely that portion between the compressed ends 14 and 16 thereof. It is preferable to use a grinding wheel 23, as illustrated, as the boring tool 22 to aid in obtaining a smoother and arcuate interior taper.

Figure 3:
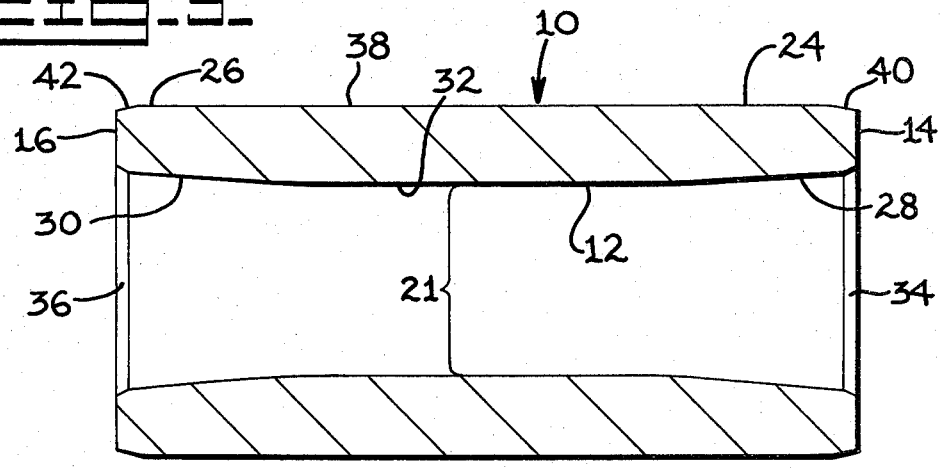
FIG. 3 illustrates an enlarged finished bushing produced in accordance with the embodiment of FIGS. 1 and 2 and utilizing an apparatus in accordance with an embodiment of the present invention.

After the aforementioned boring is completed, the ends 14 and 16 of the bushing 10 are released from the compression whereby the respective external diameters 24 and 26 of the ends 14 and 16 return towards their uncompressed size and the interiors 28 and 30 (See FIG. 3) respectively of the ends 14 and 16, respectively, of the bushing 10 have a generally uniform outward flaring or tapering. The transition between the interiors 28 and 30 of the ends 14 and 16 and a central portion 32 of the bore 12 is quite smooth in this method of operation and pin damage does not occur.

Referring again to FIG. 3, it will be seen that the bushing 10 has been deburred at the ends 14 and 16 thereof to form respective internal chamfers 34 and 36 and that the exterior 38 of the bushing 10 has been machined at the ends 14 and 16 thereof and deburred to form gradual transition areas 40 and 42, respectively, for smooth fitting relation with allied support structures.

The deforming of the bushing 20 at the ends 14 and 16 thereof is generally elastic deforming and the bushing 10 then returns substantially to its original external diameters at 24 and 26 following the releasing step. Such bushing are generally made of very high tensile strength steel whereby such compression of the ends can be accomplished without exceeding the elastic limit of the material.

Figure 4:
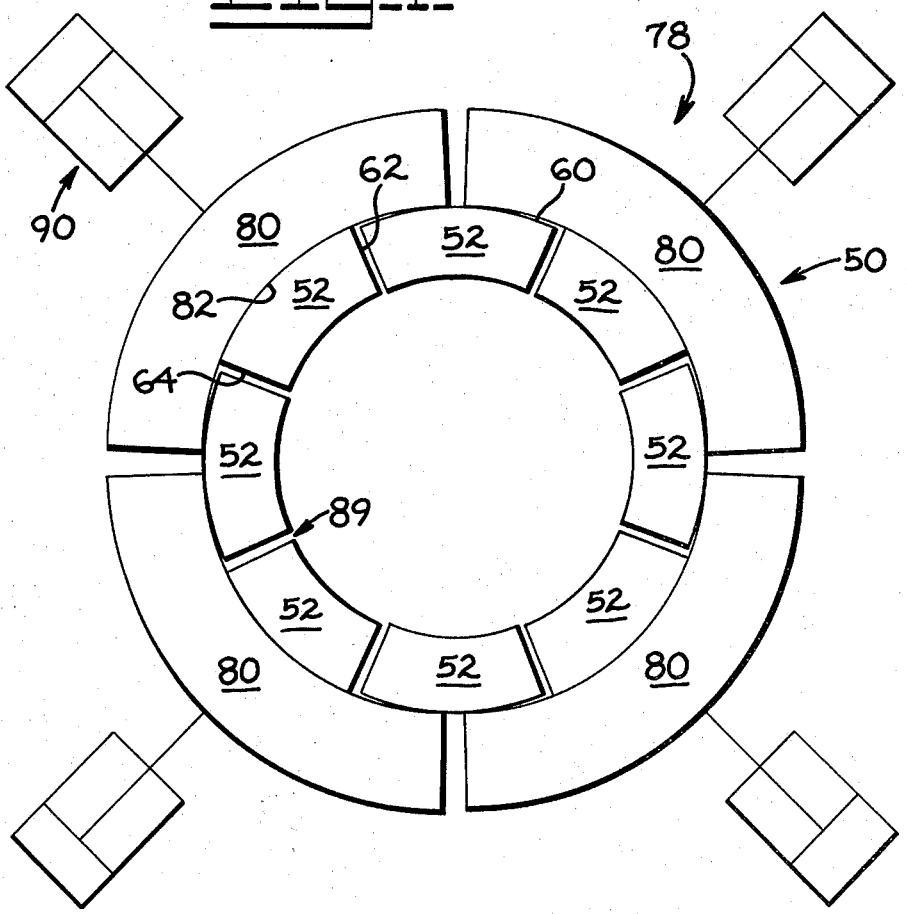
FIG. 4 illustrates an embodiment of an apparatus in accordance with an embodiment of the present invention, partially schematically.
Figure 5:
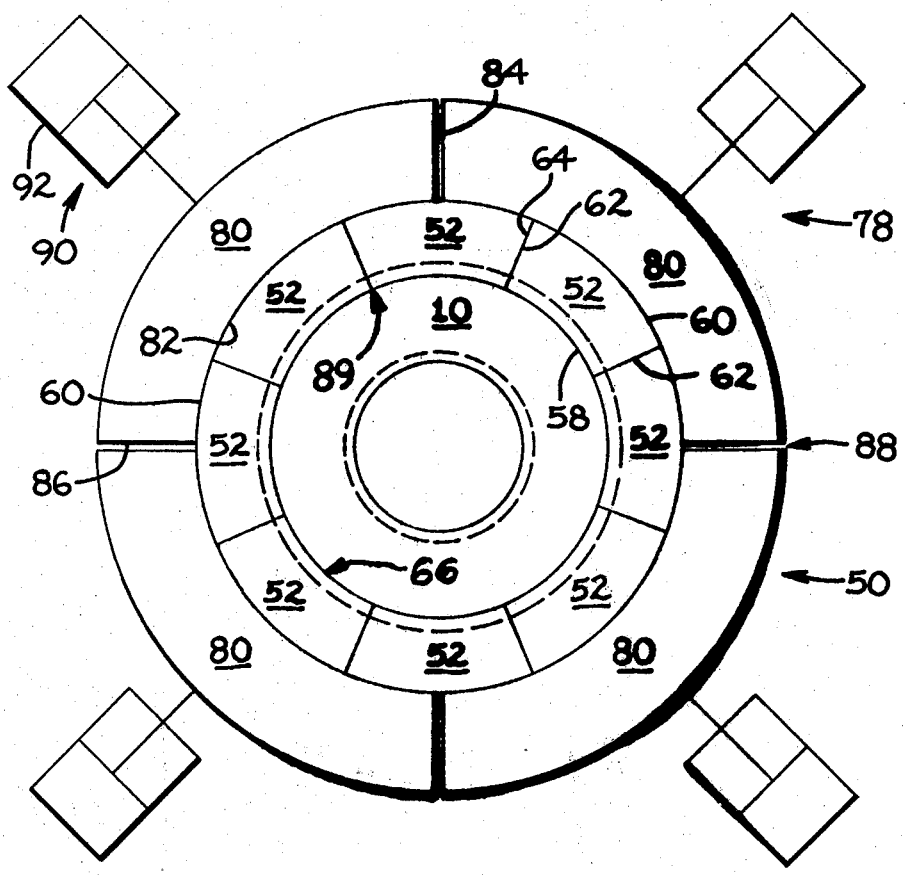
FIG. 5 illustrates a view similar to FIG. 4 via dashed and solid lines but at steps in the method of the present invention corresponding to the steps of FIG. 2.

Adverting now primarily to FIGS. 4 and 5, there is illustrated therein apparatus 50 in accordance with the present invention. The apparatus 50 serves for uniformly radially inwardly compressing the ends 14 and 16 of cylindrically bored tubes such as the bushing 10. Briefly, the apparatus 50 includes a plurality of generally arcuate compression segments 52, seen also in FIGS. 1 and 2. Each of the compression segments 52 has a front face 54 and a back face 56 seen in FIGS. 1 and 2. The compression segments 52 also have an inward radial face 58, an outward radial face 60 as well as a pair of ends 62 and 64. Respective ends 62 and 64 of adjacent of the compression segments 52 abuts one another end-to-end to form a circular ring 66 which (see FIGS. 1 and 2) has a first internal diameter 68 formed at inward radial edges 69 of the front faces 54 and a second internal diameter 70 formed at inward radial edges 71 of the back faces 56. The inward radial faces 58 of the compression segments 52, when in end-to-end abutment, define a substantially frustoconical inward facing surface 72.

Means 78 (FIGS. 4 and 5) are provided for uniformly radially inwardly compressing the compression segments 52 to form the aforementioned circular ring 66. It will be seen that in the embodiment illustrated the aforementioned compressing means 78 includes a plurality of generally arcuate outer segments 80, each having an inward radial face 82 which abuts the outward radial faces 60 of at least two of the compression segments 52. The outer segments 80 are of a construction such that they do not abut one another at respective ends 84 and 86 thereof to form a complete annulus when they are moved inwardly sufficiently far to cause segments 52 to abut one another, end 62 to end 64. Thus, a small gap 88 will generally exist between adjacent of the outer segments 80 after the ends 62 and 64 of each of the segments 52 have abutted whereby each of the bushings 10 which is to be compressed at the end thereof must be equally compressed with the abutting of the ends 62 and 64 of segments 52 serving as stop means 89 to assure this precise degree of compression.

Means 90 is provided for motivating the outer segments 80 radially inwardly and outwardly. In the embodiment of FIGS. 4 and 5, said motivating means simply comprises a plurality of conventional hydraulic or pneumatic cylinders 92, one of which motivates each of the outer segments 80 in a conventional manner.

INDUSTRIAL APPLICABILITY

The present invention is particularly useful for producing bushings which are used as bearing for pins in track roller arrangements for endless track vehicles and the like. A bushing 10 is clamped at both of its ends 14 and 16 utilizing the compressing means 78, and a boring tool 22 bores axially through the bushing from the first end 14 thereof to the second end 16 thereof. The compressing means 78 is then released and the ends 14 and 16 of the bushing 10 spring outwardly so that their external diameters at 24 and 26 return to their original size. The resulting bushing has a cylindrical surface at 32 and outwardly tapered internal diameters at 28 and 30 near the ends 14 and 16. A pin then can be easily and quickly inserted within a respective one of the bushings 10, and, even when the ends 14 and 16 of the bushing 10 are connected to support members and must bear heavy stresses, the pin can readily turn within the bore 12. That is, any slight deformation at either the end 14 or the end 16 of the bushing 10 due to its connection to a structural member is generally not sufficient to cause any binding of the pin within the bore 12. Utilizing the apparatus 50 as described above and the method set out above, such bushings 10 can be formed very quickly and with a smooth and continuous internal bore 12 from the first end 14 to the second end 16 of the bushing 10 thus preventing pin galling during use.

Other aspects, objectives, and advantages of this invention can be obtained from the study of the drawings, the disclosure and the appended claims.

We claim:

1. A method of forming tapers internally on ends (14,16) of tubes (10) having cylindrical bores (12), comprising:

compressing a first end (14) of a tube (10) having a cylindrical bore (12) radially inwardly sufficient to force said first end (14) to deform to a reduced internal diameter (18) which is of lesser size than the first end (14) internal diameter (21) in the absence of said compressing;

boring said tube (10) axially inwardly from said first end (14) with a boring tool (22) while said tube is compressed which bores a hole of a diameter (21) greater than said reduced internal diameter (18); and releasing said first end (14) compressing to allow an external dimension (24) of said first end (14) to return towards its uncompressed size with concomitant generally uniform outward flaring of an interior portion (28) of said bore (12) at said first end (14).

2. A method as in claim 1, including, prior to said boring step:

compressing a second end (16) of said tube (10) radially inwardly sufficient to force said second end (16) to deform to a reduced internal diameter (20) of lesser size than the second end (16) internal diameter (21) in the absence of said compressing; and wherein said boring step includes boring with said boring tool (22) through the entire length of said tube (10) from the first end (14) to the second end (16) thereof while the second end (16) is compressed to bore a hole thereat of a diameter (21) greater than said reduced internal diameter (20); and including:

releasing said second end (16) compressing to allow the external dimension (26) of said second end (16) to return towards its uncompressed size with concomitant generally uniform outward flaring of an interior portion (30) of said bore (12) at said second end (16).

3. A method as in claim 1, wherein said radially inward radial compressing is to a preselected extent.

4. A method as in claim 1, wherein said deforming does not exceed inherent elastic limits of material from which said tube (12) is constructed.

5. An apparatus for uniformly radially inwardly compressing the ends (14,16) of a cylindrically bored tube (10), comprising:

a plurality of generally arcuate compression segments (52), each having a front face (54), a back face (56), an inward radial face (58), an outward radial face (60), and a pair of ends (62,64), said compression segments (52) abutting together end (62)-to-end (64) to form a circular ring (66) having a first internal diameter (68) formed at inward radial edges (69) of said front faces (54) and a second and larger internal diameter (70) formed at inward radial edges (71) of said back faces (56), said inward radial faces (58) of said compression segments (52) defining a substantially frustoconical inward facing surface (72); and means (78) for uniformly radially inwardly compressing said segments (52) to form said ring (66).

6. An apparatus as in claim 5 in which said means (78) upon compressing said segments (52) further engages said tube (10) within said ring (66), said apparatus further including:

means (22) for boring an axial hole (12) into said tube (10).

7. An apparatus as in claim 5, wherein said compressing means (78) includes:

a plurality of generally arcuate outer segments (80), each having an inward radial face (82) which abuts said outward radial face (60) of at least two of said compression segments (52), said outer segments (80) not abutting one another to form a continuous annulus when moved inwardly sufficiently far to cause said compression segments (52) to abut end (62)-to-end (64); and means (90) for motivating said outer segments (80) radially inwardly and outwardly.

* * * * *